United States Patent [19]

Platt

[11] 4,075,876

[45] Feb. 28, 1978

[54] FILTER SYSTEM FOR WASHING MACHINE

[75] Inventor: Clark I. Platt, St. Joseph, Mich.

[73] Assignee: Whirlpool Corporation, Benton Harbor, Mich.

[21] Appl. No.: 680,675

[22] Filed: Apr. 27, 1976

[51] Int. Cl.[2] ..... D06F 13/02; D06F 39/10

[52] U.S. Cl. ..... 68/18 F; 210/167; 210/408; 210/411

[58] Field of Search ..... 68/18 F, 18 FA; 210/167, 408, 409, 411, 495; 134/110, 111

[56] References Cited

U.S. PATENT DOCUMENTS

| | | | |
|---|---|---|---|
| 2,720,771 | 10/1955 | Lewis | 68/18 F X |
| 2,854,141 | 9/1958 | Barnstead | 210/167 |
| 2,939,305 | 6/1960 | Snyder et al. | 68/18 F |
| 3,352,130 | 11/1967 | Landwier | 68/18 F |
| 3,772,902 | 11/1973 | Noguchi | 68/18 F |

*Primary Examiner*—Philip R. Coe

*Attorney, Agent, or Firm*—Hill, Gross, Simpson, Van Santen, Steadman, Chiara & Simpson

[57] ABSTRACT

A filter barrier or ring fixed to the bottom of a washing machine basket includes a plurality of closely spaced flexible teeth in a circumferential row extending outwardly and downwardly to divide the tub into first and second zones for filtering laundry liquid during a washing cycle. The teeth deflect in response to centrifugal spinning forces to effect self-cleaning.

16 Claims, 6 Drawing Figures

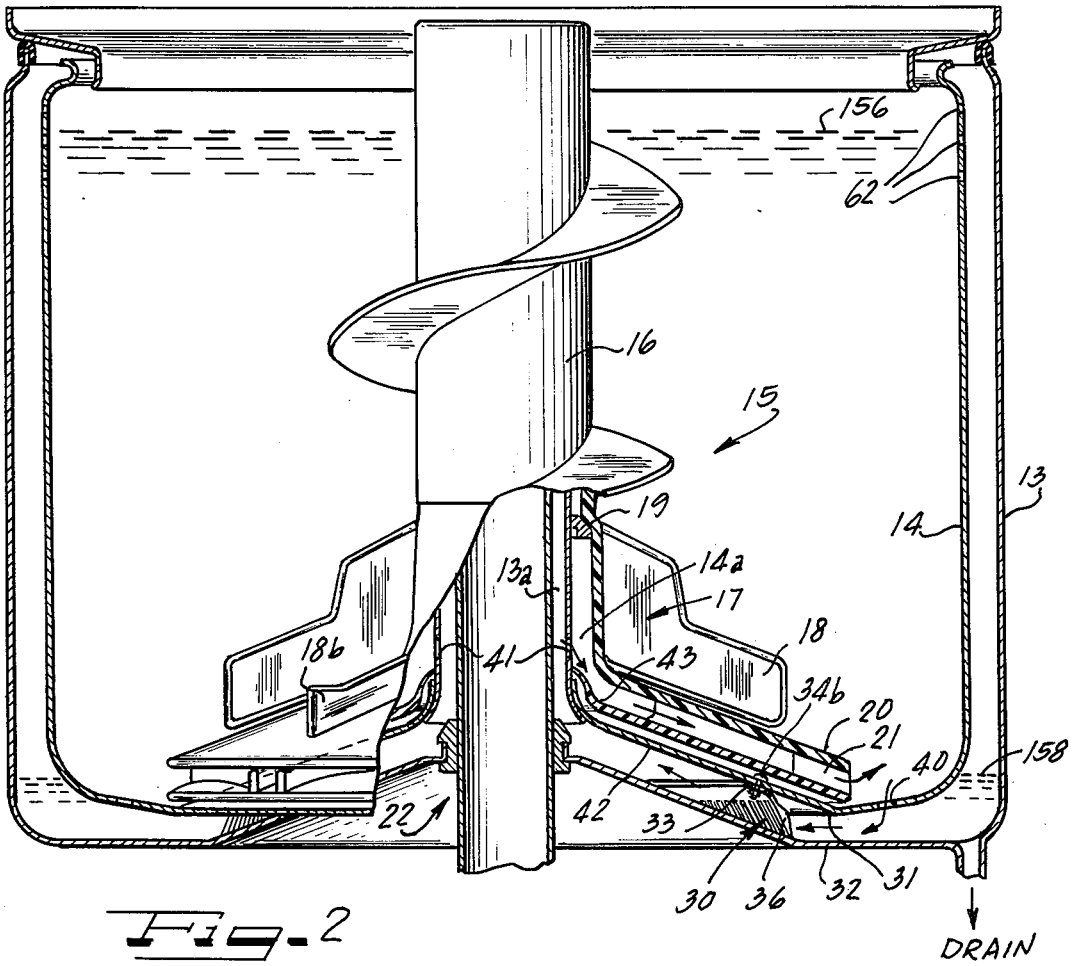
Fig-2
Fig-4
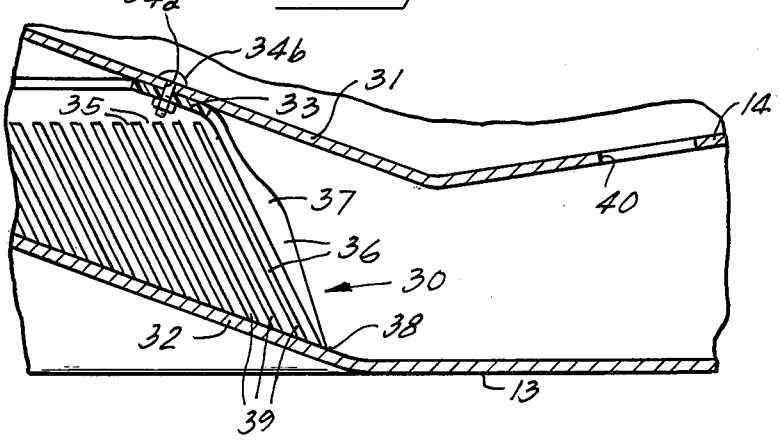

FILTER SYSTEM FOR WASHING MACHINE

BACKGROUND OF THE INVENTION

1. Field of the Invention

The present disclosure pertains to a filter system for a washing machine of the vertical axis type.

2. Description of the Prior Art

In the agitation and scrubbing of articles in a home washing machine, particles of lint are developed from the fabrics being cleaned and become suspended in the wash liquid. Unless these lint particles are removed from the washing fluid adjacent the fabrics they will eventually be distributed throughout the washing load and attach themselves once again to the articles being laundered.

A wide variety of filter systems intended to deal with this lint problem are found in the prior art. For example, a number of references disclose filtering systems wherein wash liquid is circulated through the machine's agitator, and filter elements located on or within the agitator collect lint from the circulating liquid. Other references show filtering systems which utilize a pump to circulate wash liquid between the machine's receptacle and a filter remote from the receptacle. Still other prior art filter systems circulate wash liquid from the machine's tub to the basket and back to the tub while providing filtering means associated with a wall of the basket or in a region between the tub and the basket.

U.S. Pat. No. 3,352,130 discloses a filtering arrangement in an automatic washer wherein liquid is pumped from a tub to a clothes receptacle or basket by the pumping action of an agitator oscillating within the basket during the washing cycle. Liquid enters the basket from the tub through openings in the bottom of the basket, and liquid circulates from the basket to the tub through perforations in the basket sidewall. Filter elements mounted in the openings in the bottom of the basket collect the lint carried by liquid passing through the openings, and the lint thus collected is thrown off and carried to drain when the basket spins during the centrifuging mode of machine operation.

U.S. Pat. No. 2,939,305 discloses a filtering system in an automatic washer wherein a substantially imperforate tub includes flow passages formed along a sidewall thereof, and a vertically reciprocating agitator within the tub causes liquid in the tub to flow downwardly through said passages during a washing cycle. A filter box located in each of the passages includes a plurality of tines for collecting lint carried by liquid passing therethrough.

U.S. Pat. Nos. 2,943,474 and 3,246,837 each disclose different filter systems wherein a filter member in the form of a trough or saucer mounted in the tub of an automatic washer beneath a basket receives wash liquid from the basket during a washing cycle. The wash liquid passes from the basket through small openings in the bottom of the basket and collects in the filter member, with the liquid so collected passing through or overflowing the filter member into the tub to be pumped back to the basket. Foreign particles collected by the filter member are thrown outwardly into the tub during spin and thereafter pumped to drain.

SUMMARY OF THE INVENTION

A filter ring constructed of a flexible material such as plastic or rubber is fastened to the underside of the bottom of a clothes basket, the filter ring having outwardly and downwardly extending teeth or fingers biased to extend to and contact the bottom of the tub along a generally circular line. As a pumping agitator mounted in the basket draws liquid along a path radially inward from the periphery of the tub sump beneath the basket, lint carried by the liquid is trapped on and between the teeth of the filter ring. The liquid is drawn through apertures in the basket center post and into the basket through the agitator. During the spin mode the end portions of the teeth or fingers of the filter ring tend to flex upwardly and outwardly due to centrifugal and other forces, washing and throwing off lint collected on and clinging to and between the teeth or fingers. The lint then moves to drain from the tub along with the wash liquid, the filter thus not requiring manual cleaning. It is also a feature of the invention that the lint is substantially shredded by contact with the filter ring before being passed to drain. In another form of the invention the teeth or fingers of the filter ring extend towards but do not contact the bottom of the tub.

BRIEF DESCRIPTION OF THE DRAWINGS

FIG. 2 is a cross-sectional view through the tub and basket of the automatic washer, with the agitator shown partially in plan view and partially cut way to show the filter ring and pumping agitator parts in cross-section.

FIG. 4 is an enlarged cross-sectional view through the bottom of the tub and basket and the filter ring.

DESCRIPTION OF THE PREFERRED EMBODIMENT

Figure 1:
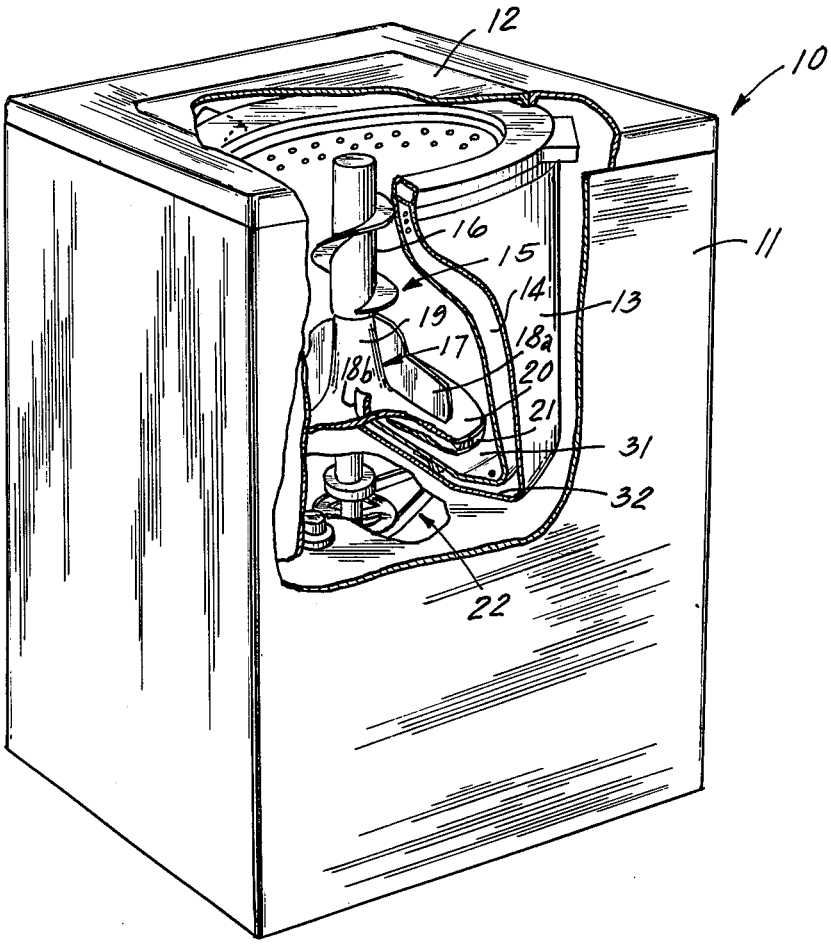
FIG. 1 is a general perspective view of an automatic washing machine partially cut away to show the placement therein of the pumping assembly and filter ring of the present invention.

An automatic washing machine of the vertical axis type is shown generaly at 10 in FIG. 1. The washer 10 comprises a cabinet 11 having a top access door 12 beneath which are mounted coaxially, a tub 13 and clothes basket 14. Within the tub 13 and basket 14 is an agitator assembly 15, comprising an upper auger portion 16 and a lower agitator portion 17. The agitator portion 17 has a plurality of flexible vanes **18*a* extending from a center post portion 19 thereof and a plurality of scrubbing vanes 18*b* affixed to a skirt portion thereof. The skirt 20 includes a pumping means 21. The pumping means shown and described herein is more fully described in a co-pending application for U.S. patent assigned to the same assignee as the present application; and that co-pending application, application Ser. No. 680,776 filed Apr. 27, 1976 of Platt and Clearman, is incorporated fully herein by reference. Briefly, the pumping agitator pumps wash water outwardly upon each oscillation of the agitator portion 17, by centrifugal force, from a center post zone 14*a* of the basket 14 and tub 13. Thus water is drawn from a center post portion 13*a* of the tub and into the basket. Drive means 22 for providing agitation and spin movements to the agitator assembly 15 and basket 14 are also shown adjacent the tub 13**.

Figure 3:
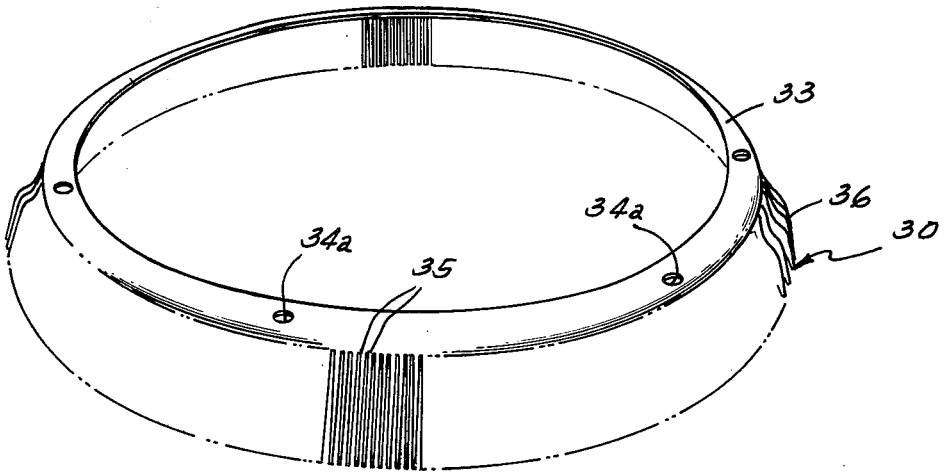
FIG. 3 is an elevational view of the filter ring of the present invention.

In accordance with the principles of the present invention, a filter ring 30 is mounted to a bottom wall portion 31 of the basket 14 coaxially therewith and contacts an upper surface of the bottom portion 32 of the tub 13 to divide the volume of the tub outside the basket into a first region and a second region, said second region radially outwardly of said first region or chamber. As shown in FIG. 3, the filter ring 30 includes a generally radially-extending annular attachment portion 33 extending at an angle with the horizontal which conforms to that of the bottom wall portion 31 of the basket 14. Mounting apertures 34*a* are formed in the attachment portion 33 to facilitate attachment of the filter ring 30 to the basket 14 by rivets or bolts 34*b*.

The filter ring 30 also includes a plurality of flexible teeth or fingers 36 connected to and extending outwardly and downwardly from the attachment portion 33 as at 35. The fingers or teeth may, as an example, number between 400 and 500 formed about the periphery of the attachment portion 33. Each individual tooth or finger 36 has a radially-enlarged portion 37 approximately midway in its length between its attachment to the portion 33 and its point of contact 38 with the lower wall 32 of the tub 13. Each tooth 36 is relatively wide with respect to the narrow flow spaces 39 formed between adjacent teeth. The teeth 36 may be identical to one another, each having a uniform thickness in the circumferential direction so that the spaces 39 therebetween are also equal in the circumferential direction. As best seen in FIG. 4, the radially enlarged portion 37 of each tooth 36 causes the teeth and the spaces 39 therebetween to be somewhat wedge-shaped. It has been found that this particular tooth geometry is effective both for filtering and lint removal purposes.

The basket 14 is provided with a first set of holes or openings 41 through a wall in a center post portion thereof. A second set of openings 40 are formed in the bottom wall 31 of the basket 14 outwardly of the basket center post and the agitator skirt 20. The segment of basket wall (identified as 42) between the two sets of openings is imperforate. These openings 40 and 41 allow a circulation to be established through the tub 13 by action of the pumping agitator. Wash water flows from the interior of the basket 14, through the second set of openings 40 therein into the tub 13. It is drawn radially inwardly along the space between the bottom 31 of the basket 14 and the bottom 32 of the tub 13 through the filter ring 30 to the first set of openings 41, and then is pumped back into the basket 14 through the flow channels of the pumping agitator. An inwardly-extending flange 43 forming a lip seal extending from the bottom wall of the pumping agitator into wiping contact with the center post prevents radially inward flow in the basket beneath the agitator skirt 20.

Lint and other foreign materials suspended in the wash liquid are captured by and between the filter teeth or fingers 36 as the wash liquid circulates in and out of the basket 14. The filter ring forms an annular barrier in the above-described circulating flow to such foreign materials while allowing the liquid to pass freely. Thus, lint-laden water will pass from the basket 14 via the openings 40 and filtered water will return to the basket through the openings 41 as the pumping agitator operates. Re-depositing of lint and other foreign material on clothing within the basket 14 is thus substantially reduced or prevented.

Upon completion of a washing cycle, the basket 14 and agitator assembly 15, together with the filter ring 30 carried on the basket 14, will spin in a liquid extraction cycle during which wash liquid is centrifuged from the clothes and the basket. Wash liquid lying between the tub and basket radially inwardly of the filter ring 30 will be flung outwardly, passing through the filter in a direction opposite to that of the liquid flow during the washing cycle. The liquid thus will rinse lint from the teeth 36 and carry it to drain. Since the teeth 36 are formed of a flexible material, they will flex radially outwardly under the centrifugal forces and turbulent water flows developed during spinning. It has been noted that this flexing combined with the rinsing action of the flow of water will cause the shredding of the lint captured on and in the spaces between the teeth and will effectively clean the lint from the filter ring. During this centrifuging operation water within the basket 14 passes upwardly under the influence of centrifugal forces and exits into the tub 13 over the top of the basket 14 or through spin outlet openings 62 in the upper portion of the basket sidewall. The basket sidewall may be upwardly tapered to facilitate such liquid removal therefrom.

Figure 5:
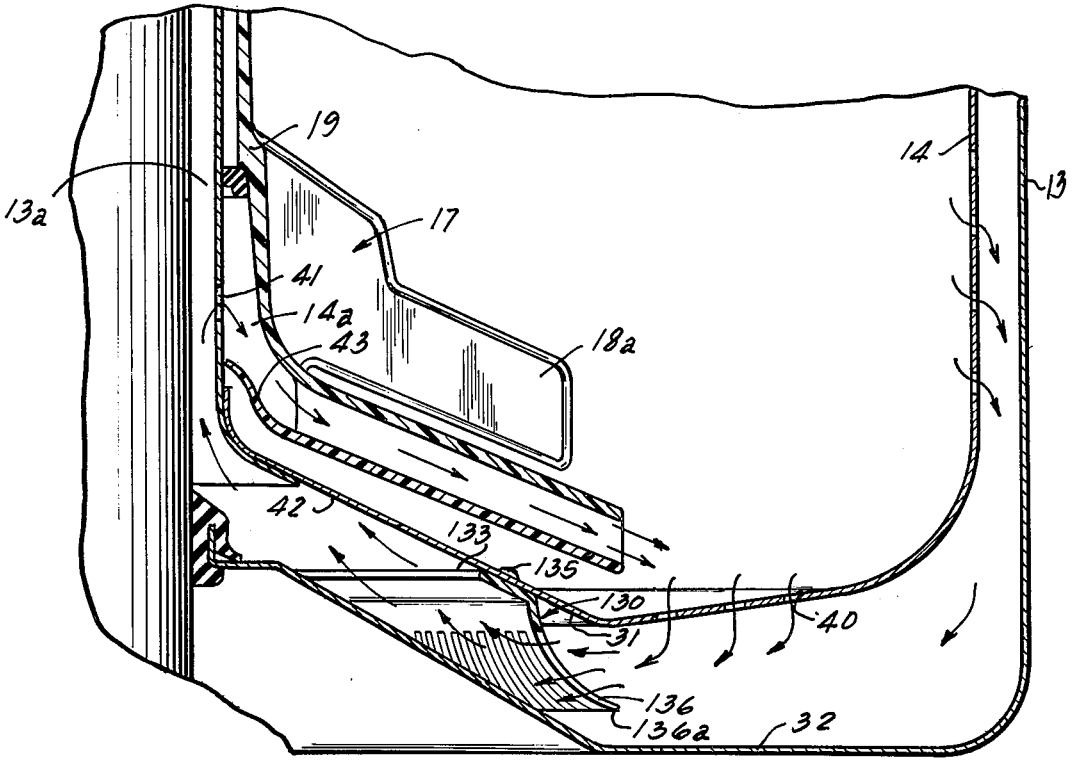
FIG. 5 is an enlarged cross-sectional elevation of the tub, basket, agitator, and filter ring of a washer utilizing a modified form of the invention.

Referring to FIG. 5, an alternative embodiment of the filter ring according to the present invention is shown. As shown in FIG. 5 the filter ring 130 includes an annular attachment portion 133 generally similar to the portion 33 shown in FIG. 3, and a plurality of flexible closely-spaced teeth or fingers 136. The filter ring 130 is fixed to the bottom of the basket 14 by means of mechanical fasteners 135.

In this modified embodiment the filter teeth 136 do not extend downward all the way to the upper surface of the tub's bottom wall 32, and a space is thereby provided between the lower ends 136*a* of the teeth and the bottom wall 132 of the tub. The teeth 136 are curved radially outwardly or concave facing the second tub region as shown and collect a major portion of the lint carried by the wash liquid passing beneath the basket between the openings 40 and 41 despite the space between the teeth and the tub wall. The space between the lower ends 136*a* of the teeth and the bottom wall 132 of the tub in this alternative embodiment advantageously provides a fluid passageway around the filter ring 130 so that in the event the filter ring becomes plugged (for example, by a heavy collection of lint) there will still be fluid circulation through and between the tub and basket. Also, since this space is provided between the lower ends of the teeth and the bottom wall 32 of the tub there will be no abrasion damage or wear inflicted by the teeth on the tub wall surface as the basket 14 rotates with respect to the tub 13.

Figure 6:
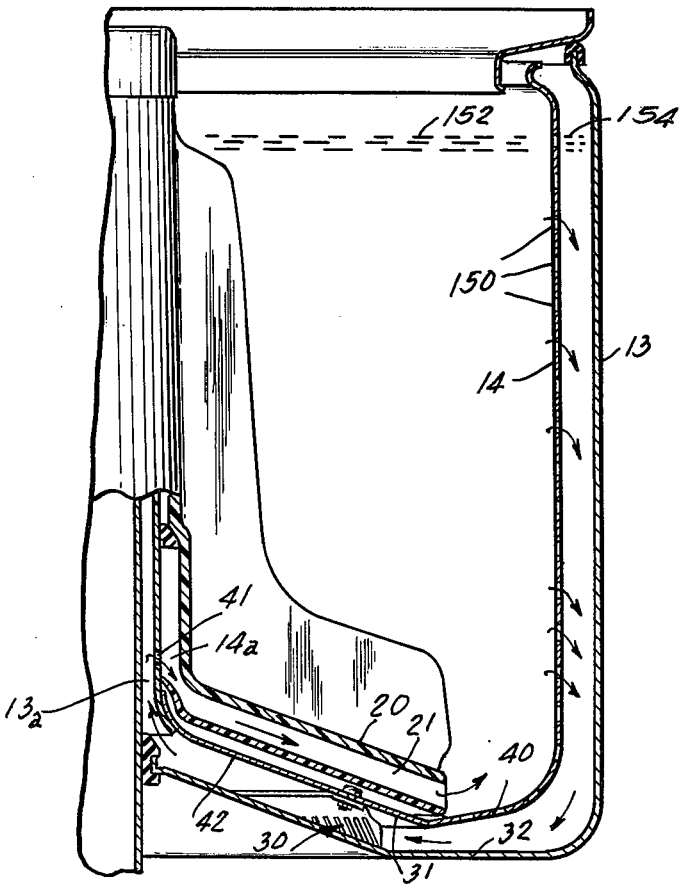
FIG. 6 is a view similar to a portion of FIG. 2 but showing a basket having a perforate rather than an imperforate sidewall.

The self-cleaning filter according to this invention may be utilized effectively in washers wherein the liquid levels in the tub and basket are substantially equal as shown in FIG. 6 and in washers wherein a level differential is maintained between the liquid in the basket and the liquid in the tub outside the basket as shown in FIG. 2. Thus, as shown in FIG. 6, the basket 14 includes a perforate sidewall and liquid runs freely out of the basket through the openings 40 and perforations 150 at a rate such that the pumping agitator is unable to draw liquid through the openings 41 at a rate sufficient to establish a level differential between the liquid level 152 inside the basket and the liquid level 154 outside the basket. Referring now to FIG. 2, the basket sidewall is shown as imperforate so that all circulating liquid passing from the basket must exit through the openings 40, and the pumping agitator is able to pump liquid into the basket through the openings 41 at a rate sufficient to maintain a substantial level differential between the level 156 of liquid in the basket and the level 158 of liquid in the tub outside the basket. In both the system including a perforate basket sidewall (FIGS. 5 and 6) and the system including an imperforate basket sidewall (FIG. 2) the flow rate past the filter ring will be of a nature to allow effective filtering.

Although a filter ring having fingers or teeth of a configuration like those shown in FIGS. 2 and 6 is preferred, it will be understood that many different forms of filtering barriers and many different configurations of lint collecting teeth could be effectively utilized within the scope of my invention. These and other various modifications might be suggested by those versed in the art; it should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a washing machine of the vertical axis type having a tub having a lower wall for containing wash liquid, a basket mounted in the tub on said vertical axis for containing articles to be washed and having a lower wall spaced adjacent said wall of the tub, and pump means for circulating wash liquid to said basket from said tub; filter means for filtering the circulating wash liquid, said filter means comprising:

a filter ring being located entirely outside said basket and extending between said lower wall of said tub and said lower wall of said basket and being substantially circumferentially continuous about said axis to define annularly continuous first and second tub regions outside said basket wall, said filter ring including a plurality of teeth for filtering suspended foreign particles from liquid passing from said second to said first tub region, said circulating liquid flowing generally along a path in said first tub region along said lower wall of said basket, into the interior of said basket, from the basket into said second tub region, and past said filter ring back to said first tub region.

2. In a washing machine as claimed in claim 1, wherein the basket comprises a substantially cylindrical, apertured center post extending upwardly from the lower wall and said pump means comprises a pumping agitator mounted for oscillation in said basket to draw liquid through and past said filter ring into said first tub region and into said basket through the apertured center post.

3. In a washing machine having a tub having a lower wall portion for containing wash liquid, a basket mounted in the tub for containing articles to be washed and having a lower wall portion adjacent said wall portion of the tub, and pump means for circulating wash liquid to said basket from said tub, filter means for filtering the circulating wash liquid, said filter means comprising:

a filter ring extending between said lower wall portion of said tub and said lower wall portion of said basket to define first and second tub regions outside said basket, said filter ring including a plurality of teeth for filtering suspended foreign particles from liquid passing from said second to said first tub region, said circulating liquid flowing generally along a path from said first tub region, to the interior of said basket, to said second tub region, and past said filter ring back to said first tub region; and wherein said basket forms a first set of openings through said lower wall portion thereof for affording liquid communication between said first tub region and said basket interior; and wherein said basket further forms a second set of openings through said lower wall portion thereof radially outwardly of said first set of openings for affording liquid communication between said second tub region and said basket interior.

4. In a washing machine as claimed in claim 1, said basket having an outer surface and said filter ring being attached to and extending downwardly from said outer surface of said basket.

5. In a washing machine as claimed in claim 4, the filter ring having elongate, thin teeth, said teeth being flexible to flex in response to centrifuging of said basket, to facilitate self-cleaning of said filter ring.

6. In a washing machine as claimed in claim 5 wherein said teeth extend downwardly and radially outwardly in the direction of said lower wall portion of said tub.

7. In a washing machine as claimed in claim 5 wherein said filter ring spans a major portion but not all of a distance from said basket outer surface to a generally opposite inner surface of said tub lower wall.

8. In a washing machine as claimed in claim 7 wherein said teeth of said filter ring are generally concave and point into the second tub region.

9. In a washing machine as claimed in claim 4 wherein said filter ring spans a distance from said basket outer surface to a generally opposite inner surface of said tub lower wall.

10. In a washing machine as claimed in claim 3 wherein said basket includes a substantially imperforate sidewall, and wherein said pump means provides a substantially continuous flow of circulating liquid while simultaneously maintaining the liquid level in said basket above the liquid level in said tub.

11. In a washing machine as claimed in claim 3 wherein said basket includes a perforate sidewall affording liquid communication therethrough from said basket into said second tub region.

12. In an automatic washer having a tub containing wash liquid, and an axially-symmetric basket mounted within said tub containing wash liquid and items to be washed, said basket having a wall forming a first and a second set of openings through said wall and spaced radially apart from one another in said wall; a filter system for filtering foreign matter from said wash liquid during a washing operation, said filter system comprising:

pump means for providing a circulation of said wash liquid between said tub and the basket interior during said washing operation, said circulation of said wash liquid causing said wash liquid to pass from said tub to said basket through said first set of openings and from said basket to said tub through said second set of openings; and barrier means mounted between said tub and said basket spaced radially between said first and second sets of openings for dividing said tub outside said basket into a first and a second chamber, said first chamber of said tub being in liquid communication with said basket through said first set of openings and said second chamber of said tub being in liquid communication with said basket through said second set of openings, and said barrier means permitting flow of said wash liquid and substantially blocking flow of said foreign matter from said second to said first chamber of said tub.

13. In an automatic washer as defined in claim 12 and further defined by said basket wall having an underside and by said basket rotating at high speed during a liquid removal operation following said washing operation, the filter system further defined by said barrier means being a filter ring affixed to said underside of said basket, whereby foreign matter collected by said filter ring during said washing operation is rinsed from said filter ring during said liquid removal operation.

14. A filter system for an automatic washer as defined in claim 13 wherein a portion of said filter ring is flexible and flexes in response to said rotation of said basket, such flexing enhancing the removal of said foreign matter from said filter ring during said liquid removal operation.

15. An automatic washer comprising, a tub for containing wash liquid;

a basket rotatably mounted within said tub for containing wash liquid and items to be washed, said basket having a center post portion and a lower wall portion and including a first set of openings through said center post portion and a second set of openings through said lower wall portion radially outwardly of said first set of openings;

pump means for circulating said wash liquid between said first and second sets of openings, said wash liquid passing from said tub to said basket through said first set of openings and from said basket to said tub through said second set of openings; and a filter ring mounted beneath said basket and extending between said basket and said tub to form an annular barrier cooperating with said lower wall portion of said basket to divide said tub into a first chamber and a second chamber, said first chamber in liquid communication with said basket through said first set of openings and said second chamber in liquid communication with said basket through said second set of openings, said filter ring comprising an annular member including a plurality of generally downwardly and outwardly extending teeth for passing liquid but collecting foreign matter thereon, and said teeth flexing in response to rotation of said basket to release said collected foreign matter to a drain in a liquid removal cycle.

16. In a vertical axis washer having a rotatable receptacle in a tub, the receptacle having a bottom surface, a filter ring located entirely outside said receptacle and fixed to said bottom surface of said receptacle and having a substantially continuous, circumferentially disposed row of closely spaced elongate, flexible teeth extending outwardly and downwardly from said receptacle bottom surface to divide the tub outside the basket into first and second zones for filtering liquid pumped from one zone to the other during a washing cycle, said teeth flexibly deflecting along their lengths in response to centrifugal spinning forces to effect self-cleaning during a draining cycle.

* * * * *